US006854626B2

(12) United States Patent
Liao

(10) Patent No.: US 6,854,626 B2
(45) Date of Patent: Feb. 15, 2005

(54) PROTECTIVE PISTOL HOLSTER WITH SAFETY DEVICE

(76) Inventor: Chien-Chen Liao, P.O. Box No. 6-57, Chung-Ho City, Taipei Hsien, 235 (TW)

( * ) Notice: Subject to any disclaimer, the term of this patent is extended or adjusted under 35 U.S.C. 154(b) by 119 days.

(21) Appl. No.: 10/385,632

(22) Filed: Mar. 12, 2003

(65) Prior Publication Data

US 2003/0168482 A1 Sep. 11, 2003

Related U.S. Application Data

(63) Continuation-in-part of application No. 09/855,519, filed on May 16, 2001, now abandoned.

(51) Int. Cl.[7] ..... F41C 33/02
(52) U.S. Cl. ..... 224/244; 224/911
(58) Field of Search ..... 224/193, 243–245, 224/911–912, 238

(56) References Cited

U.S. PATENT DOCUMENTS

| | | | | |
|---|---|---|---|---|
| 2,001,321 A | | 5/1935 | Berns | 224/2 |
| 3,804,306 A | | 4/1974 | Azurin | 224/2 |
| 4,277,007 A | | 7/1981 | Bianchi | 224/193 |
| 4,286,741 A | | 9/1981 | Rogers | 224/193 |
| 4,925,075 A | * | 5/1990 | Rogers | 224/244 |
| 5,018,654 A | * | 5/1991 | Rogers et al. | 224/244 |
| 5,395,021 A | | 3/1995 | Brown | 224/244 |
| 5,419,474 A | | 5/1995 | Marx | 224/244 |
| 5,449,103 A | | 9/1995 | Tilley | 224/244 |
| 5,810,221 A | * | 9/1998 | Beletsky et al. | 224/244 |
| 6,112,962 A | | 9/2000 | Matthews | 224/243 |
| 6,189,751 B1 | | 2/2001 | Tserng | 224/244 |
| 6,189,756 B1 | | 2/2001 | Ward | 224/575 |
| 6,732,891 B2 | * | 5/2004 | Locklear, III | 224/244 |
| 6,752,300 B2 | * | 6/2004 | Har-Shen | 224/244 |
| 2001/0019071 A1 | | 9/2001 | Vor Keller | 224/244 |

* cited by examiner

*Primary Examiner*—Nathan J. Newhouse
(74) *Attorney, Agent, or Firm*—Troxell Law Offices PLLC

(57) ABSTRACT

A protective pistol holster with one-way safety device includes a protective holster main sandwich with several clamping devices, a pair of clamping and receiving members with triangular and trapezoidal configurations, two strip-shaped spring leaves, and a frame protecting cover. An expanding member is formed at the fold of the protective holster main sandwich. The clamping and receiving members, with triangular and trapezoidal structures, position the pistol body where the expanding member presses against the protective holster main sandwich with the assistance of the tightly forcing resilience from the middle of two spring leaves. Removal of the pistol is achieved by pressing toward the inner side of the holster near the human body.

5 Claims, 10 Drawing Sheets

PROTECTIVE PISTOL HOLSTER WITH SAFETY DEVICE

RELATED APPLICATION

This application is a continuation-in-part of U.S. application Ser. No. 09/855,519, filed on May 16, 2001 and now abandoned.

BACKGROUND OF THE INVENTION

1) Field of the Invention

The present invention relates to a protective pistol holder with a safety device, more especially a protective pistol holster having a set of clamping and receiving members with triangular and trapezoidal structures fitted with the mutual pressing of the expanding member formed according to the configuration of the pistol.

2) Description of the Prior Art

Among the available conventional protective pistol holsters, the representative ones with safety means, shown in FIGS. 1 and 1A, mainly use a clamping and receiving flange (11) with convex triangular slope (110) and a hook holding member (10) with a guide rail (13) consisting of two flanges (12) and other parts positioned on the inner side (12) of the protective pistol holster (100). After the pistol (101) is inserted into the protective holster (100), the foresight (111) moves along the guide rail (13) and over the clamping and receiving flange (11). Since the convex triangular slope (110) therein blocks the foresight, the pistol (101) will be safely placed inside the protective holster (100). When using the pistol (101), one only has to sway the pistol (101) left or right toward the direction of the protective holster (100) to make the foresight (111) deflect from contact with the clamping and receiving flange (11), to then easily draw the pistol (101). However, the existence of being swayed left or right enables the pistol (101) to be removed from the protective holster (100). Therefore, when the wearer of the gun is attacked, the attacker only has to move and sway the gun grip at a rush to easily control the gun. Thus, the efficacy of the conventional protective holster for safely preventing the gun from being ambushed fails. This is the disadvantage of the traditional protective pistol holsters and is one of the major issues to be overcome.

SUMMARY OF THE INVENTION

In view of the potential danger caused by the disadvantage of the structural design of the conventional protective pistol holster during real-time usage, the inventor of the present invention researched in depth and made a conceptual breakthrough by using a pair of triangular and trapezoidal structures integrated inside the protective pistol holster to clamp and receive the position near the pistol trigger. An expanding member, formed according to the configuration of the pistol, is pressed from the side against which the pistol is inserted and engaged in the protective holster to increase the safety efficacy of only allowing the removing of the pistol by pressing toward the inner side of the human body.

These and other objectives, advantages and features of the present invention will be further understood from the following brief description of the drawings and the detailed description of the preferred embodiments.

BRIEF DESCRIPTION OF THE DRAWINGS

FIGS. 1 and 1A are the schematic drawings of the safety device, the protective holster and the pistol stored inside the conventional protective pistol holster.

DETAILED DESCRIPTION OF THE PREFERRED EMBODIMENTS

Figure 1:
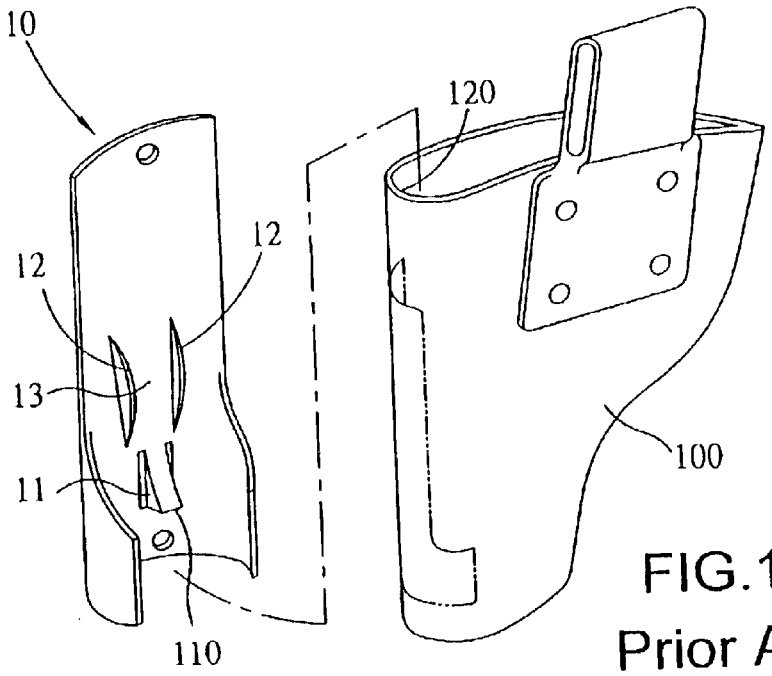
FIG.1 Prior Art
Figure 1:
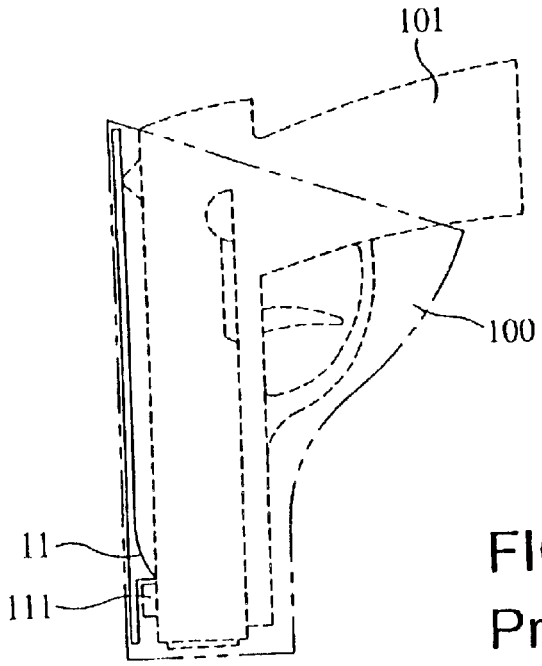
FIG.1 (A) Prior Art
Figure 2:
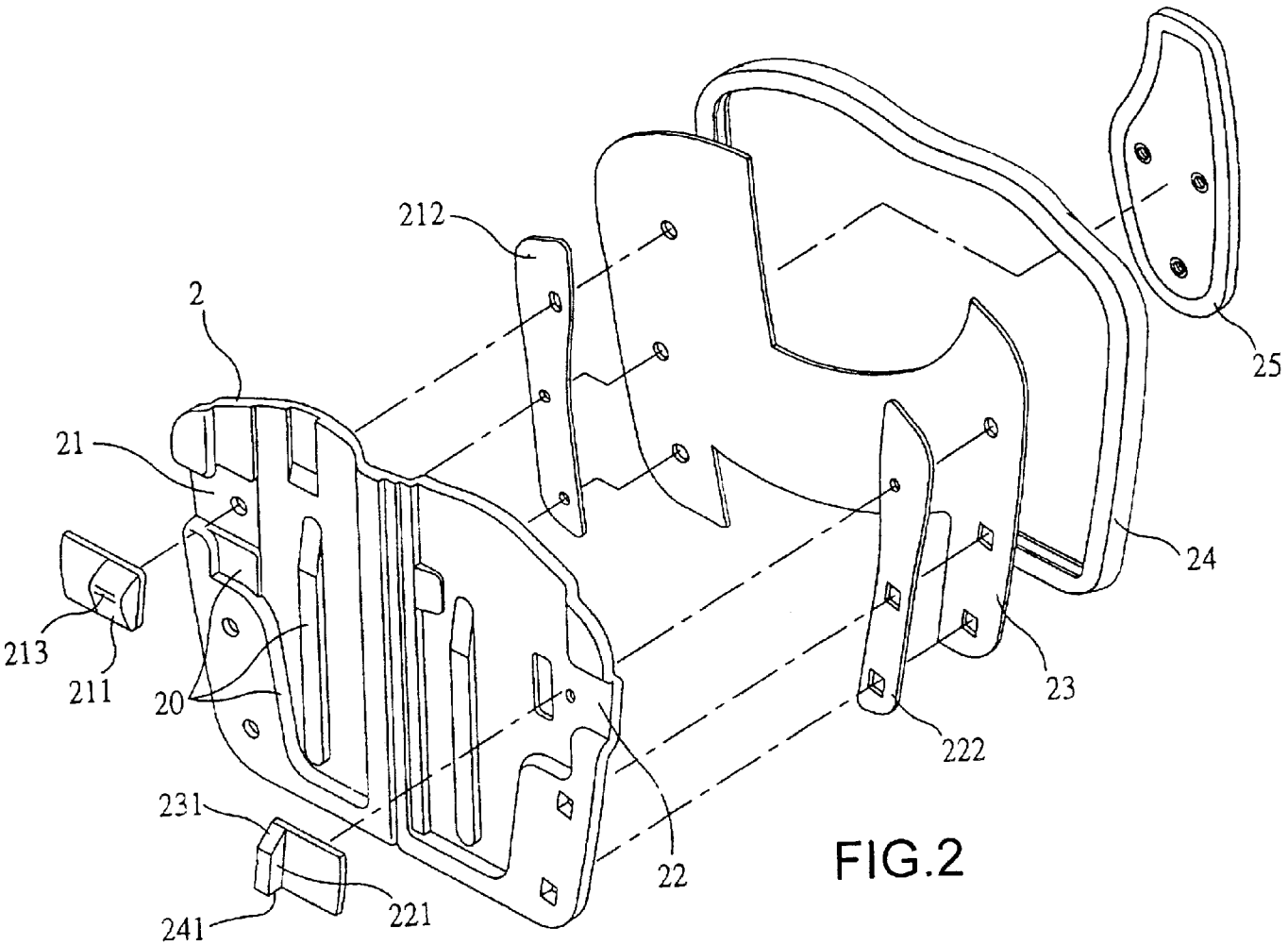
FIG. 2 is an exploded perspective view of the present invention of a protective pistol holster with one-way safety device.

FIG. 2 shows a exploded pictorial drawing of the main members of the present invention including a protective holster main sandwich (2) with parts for clamping, receiving and attaching sides. Positions (21, 22) near where the pistol trigger is located have a first, triangular clamping and receiving member (211) and a second, trapezoidal clamping and receiving member (221), wherein the inclined plane portion (231) of the clamping and receiving member (221) is sized to clamp and receive the pistol trigger, while the trapezoidal vertical portion (241) is sized to clamp and receive the inner side of the protective arch below the trigger. The triangular top portion (213) of the first clamping and receiving member (211) will fill in the space at a top of the second clamping and receiving member (221) near the trigger. When the inserted pistol is pressed toward the direction of the first clamping and receiving member (211), the pistol protective arch (along with the trigger) can be made to deflect from the original state of being clasped and positioned. At the rear side of the protective main sandwich (2) corresponding to the positions of the first and second clamping and receiving members (211, 221), at positions adjacent to the inserted pistol trigger affixes to, are two strip-shaped spring leaves (212, 222) covered by an external clasping piece (23) on the protective holster main sandwich (2). A frame protecting cover (24) is formed according to the peripheral frame rim of the protective holster main sandwich (2) to stitch and bond the clasping piece (23) into one unit. An insertion slot casing (25) having snap members disposed for fitting and tightly retaining the inserted pistol is threaded onto the external side of the clasping piece (23).

Figure 3:
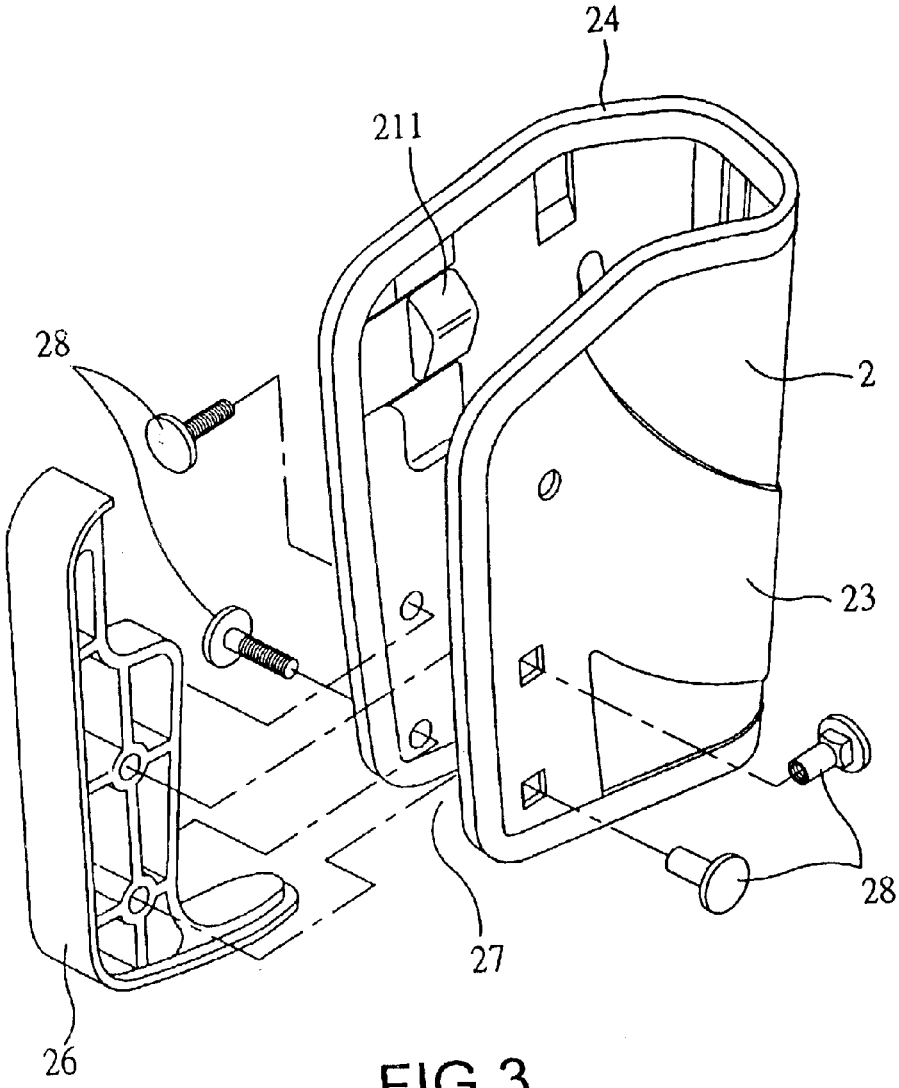
FIG. 3 is an exploded perspective view of the expanding member and the protective holster main sandwich of the present invention.

Referring to FIG. 3, in the present invention, in order to more stable position the pistol to the inner side of the protective holster main sandwich (2), an expanding member (26) is formed according to the pistol body and the formed notch (27) are between the sides of the protective holster and is further integrated with the protective holster main sandwich (2) by means of screw members (28). Slackness of the screw members (28) tightly threading the expanding member (26) can be adjusted specifically according to a particular force (depending on different people) needed to be exerted for drawing the pistol. For example, for women, the slackness can be looser than that for men just by adjusting the tightness of the screw members. The expanding member (26), plus the retaining of the pistol trigger by the first and second clamping and receiving members (211, 221) inside the protective holster (2), and the assistance of the resilient energy of position of the spring leaves inside the said main sandwich (2) enable the pistol to be safely stored in the protective holster (2).

Figure 4:
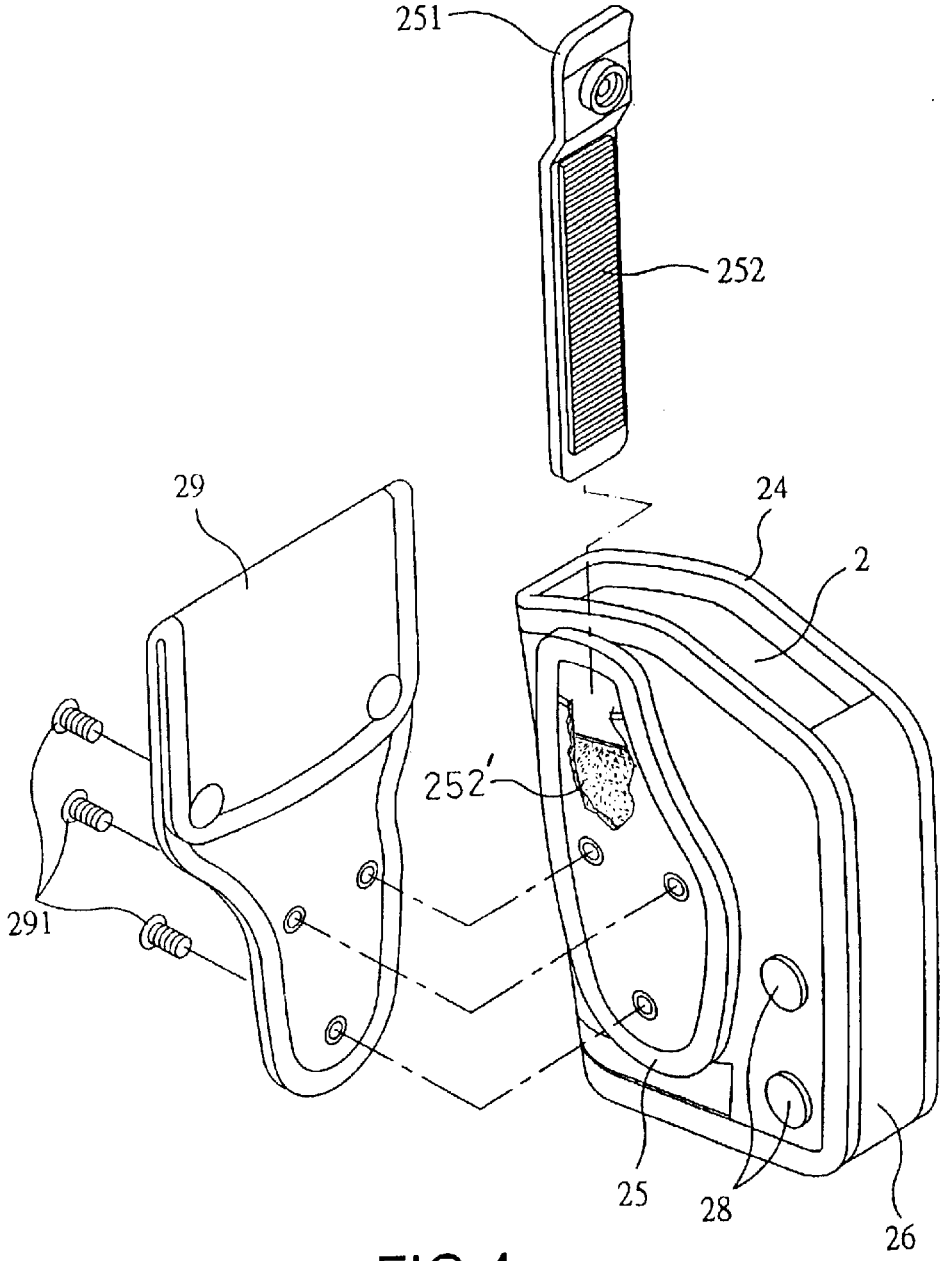
FIG. 4 is an exploded perspective view of a protective pistol holster with one-way safety device and the linked fastening member sets of the present invention.

Referring to FIG. 4, in order to position the pistol inside the protective holster (2), snap fasteners are additionally attached. Parent snap member (251) with self-adhesive fastening belt (252), the slot casing (25), on the inner side, also with self-adhesive fastening belt (252') engage each other. The through bind member (29) for attachment of the waist belt is attached to the protective holster. Since both the snap member (251) and the slot casing (25) have self-adhesive materials therein, the tension degree required for snapping the pistol butt can be adjusted by ascending or descending the snap members (251) through loosening and fastening the related screw members (291).

Figure 5:
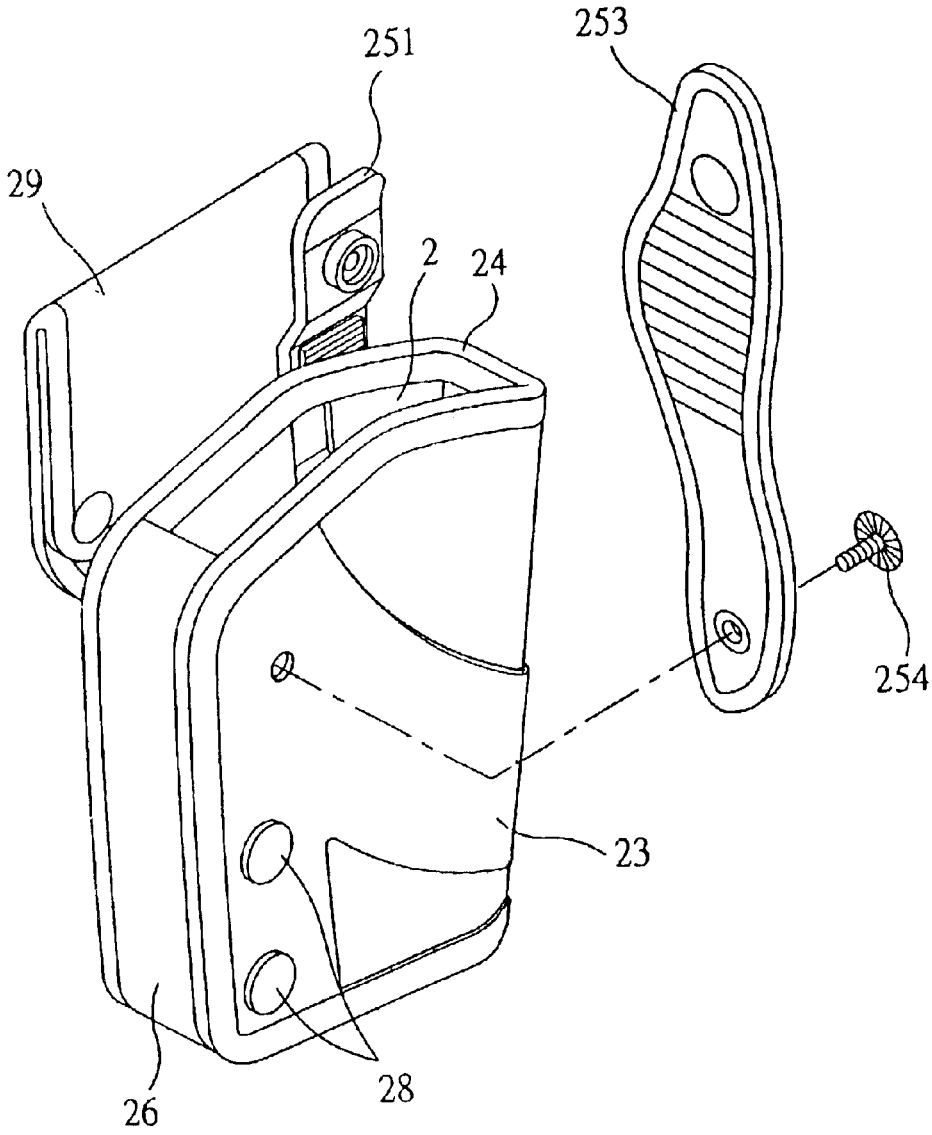
FIG. 5 is a schematic drawing of the connection between the present invention and the snap members of the pistol butt.

FIG. 5 shows the relative position of the snap-type member set, wherein, in addition to the parent snap member (251), a sub snap member (253) is fastened to the other side of the protective pistol protective holster (2) by means of the screw members (254).

Figure 6:
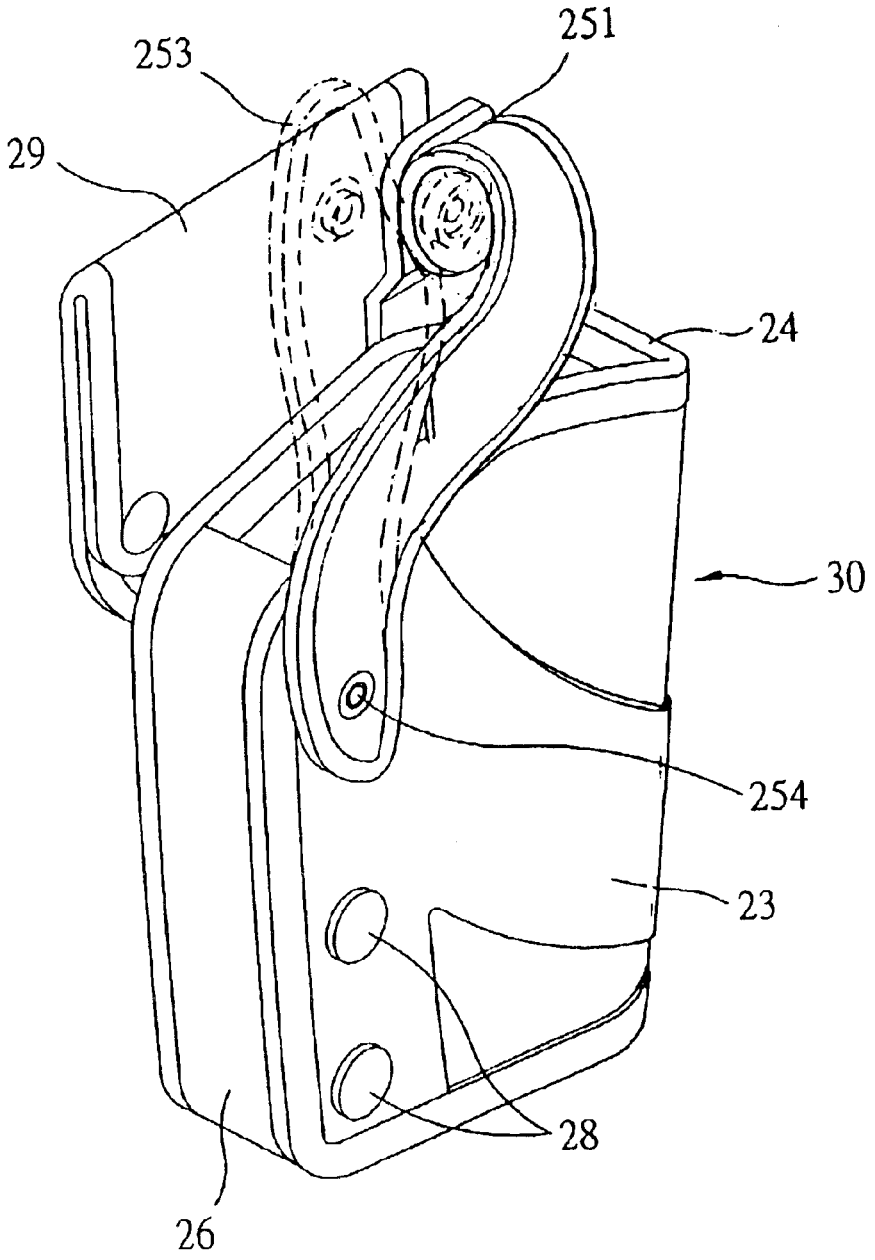
FIG. 6 is a schematic external view of the assembled present invention of a protective pistol holster with one-way safety device.

FIG. 6 is an external view of the assembled protective pistol holster with one-way safety device. The configuration of the assembly (30) of the rigid protective holster (2) has the stability required and has adequate in-time insertion of the clamping and receiving members (211, 221) attached inside the main sandwich (2), toward the pistol triggers. Undoubtably, safer protection will be provided for the inserted pistol.

Figure 7:
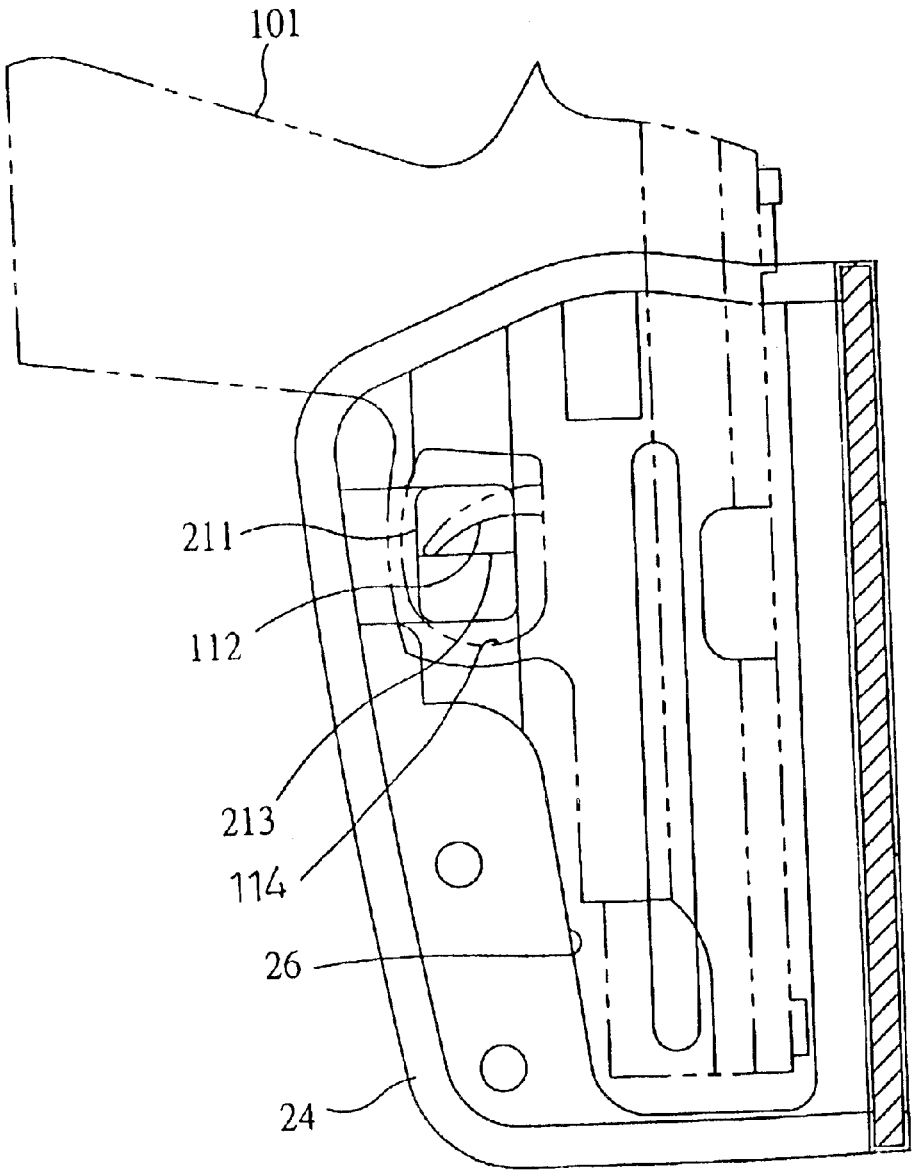
FIG. 7 is a schematic, cross-sectional view of the present invention wherein the triangular clamping and receiving member of the protective holster main sandwich is at the lower side.

FIG. 7 shows a schematic, cross-sectional view, wherein the first, triangular clamping and receiving member (211) is situated at the lower side and the trigger (112) of the pistol (101) is clamped and received by the triangular top portion (213) on the clamping and receiving member (211). Both sides of trigger (112) of the pistol (101) are thus clamped. One side is stabilized and the other side is assisted by the trapezoidal clamping and receiving member (221).

Figure 8:
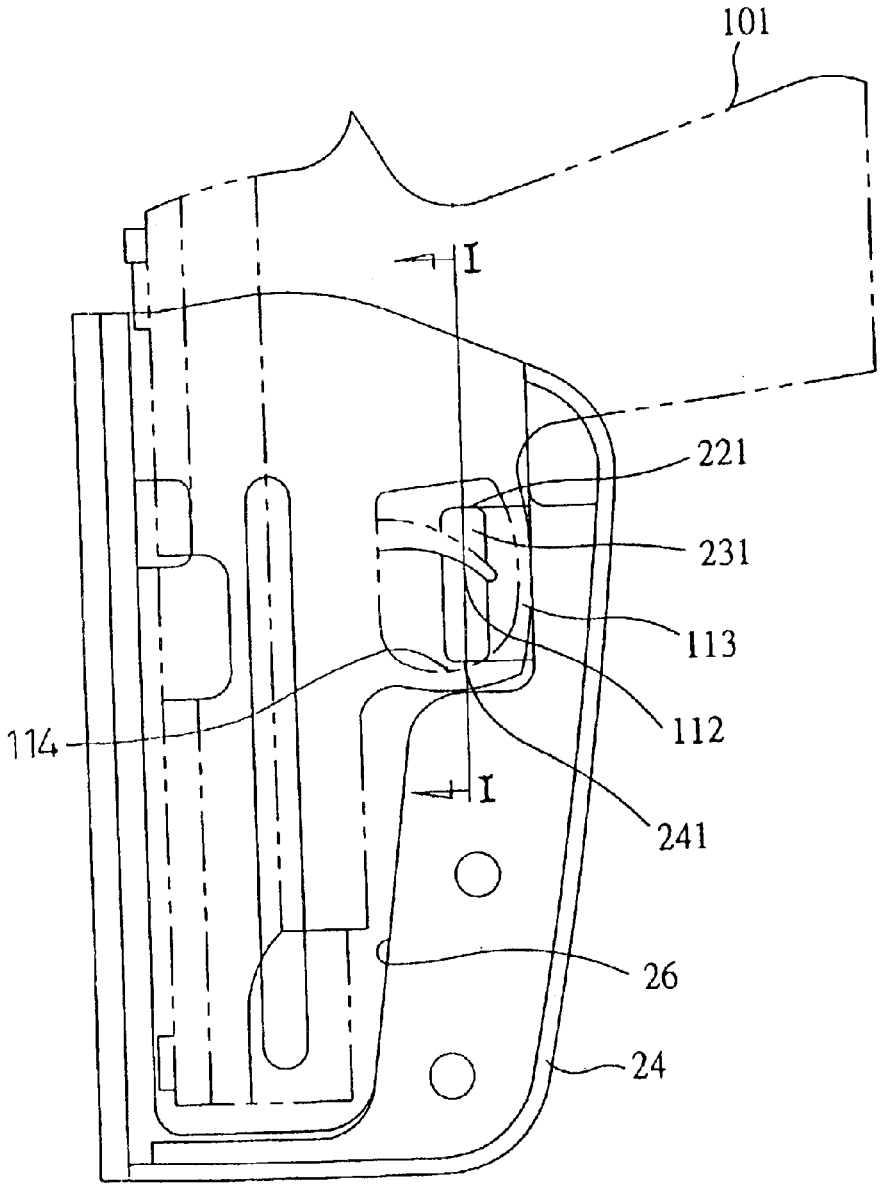
FIG. 8 is a schematic, cross-sectional view of the present invention wherein the trapezoidal clamping and receiving member of the protective holster main sandwich is at the lower side.

FIG. 8 shows a schematic, cross-sectional view, wherein the trapezoidal clamping and receiving member (221) is situated at the lower side and the trigger (112) of the pistol (101) is clamped and received by the slope (231) on the upper side of the clamping and receiving member (221). One side of the protective arch (113) of the pistol (101) is just pressed against by the vertical end (241) of the clamping and receiving member (221). Therefore, it is understood that the pistol (101) at this moment is clasped, in other words, the pistol (101) under this situation is impossible to be drawn upward or toward the rear side of the Figure (that is the normal outer side of the human body). However, the only way to change the contact state is to press and push the pistol (101) toward the direction of the first clamping and receiving member (211) (please refer to FIG. 7), that is the inner side near the human body, for drawing the pistol (101). Since two spring leaves are clasped inside the lateral web of the clamping and receiving members (211, 221), for drawing the pistol (101), one only needs to press against and exert force toward the inner side near the human body.

Figure 10:
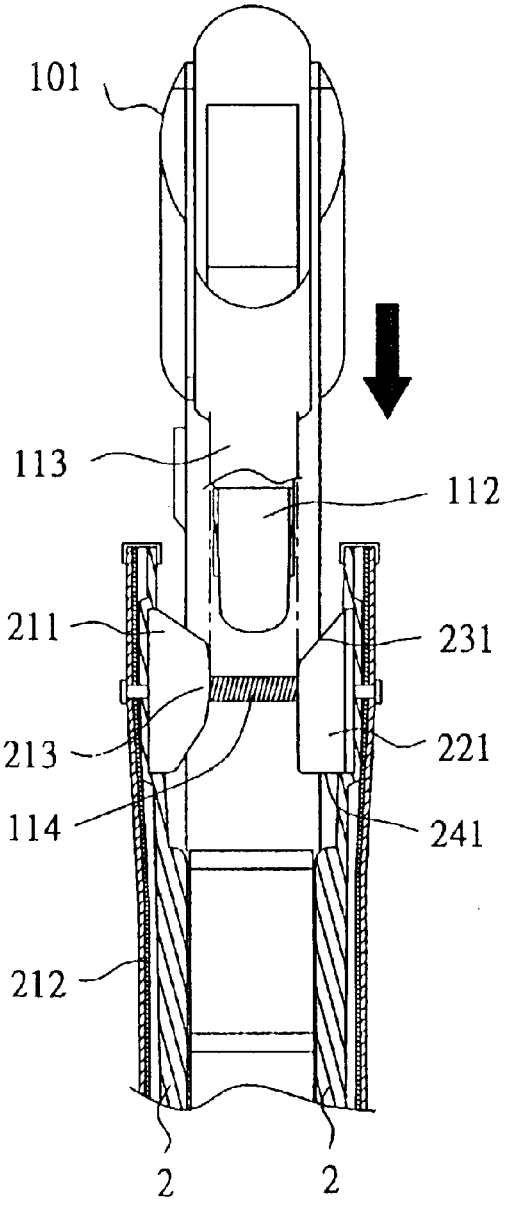
FIGS. 9–11 are schematic cross-sectional views illustrating the action of placing the pistol downwardly into the protective holster main sandwich, taken along lines I—I of FIG. 8.
Figure 9:
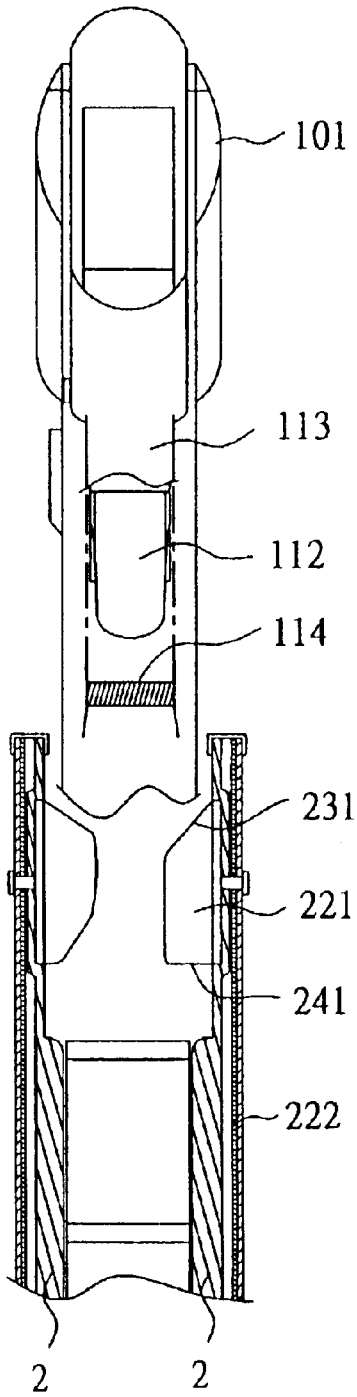
Figure 12:
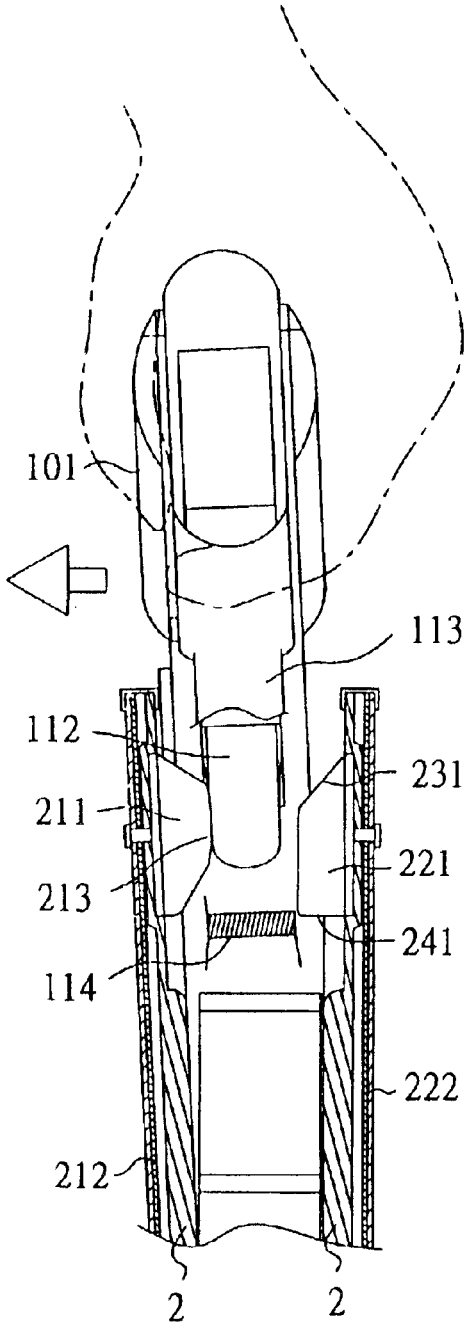
FIG. 12 is a schematic cross-sectional view illustrating the action of withdrawing the pistol upwardly out of the protective holster main sandwich, taken along line I—I of FIG. 8.
Figure 11:
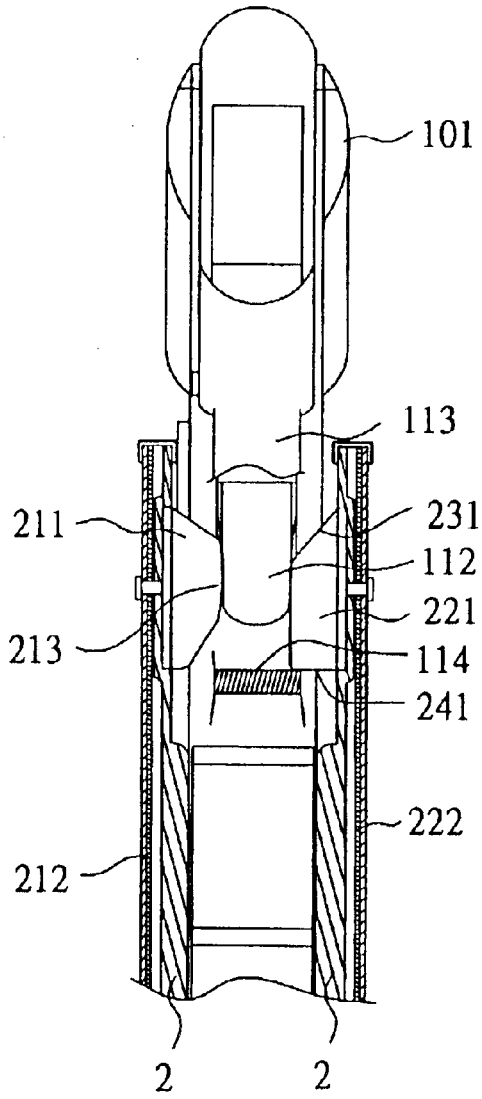

FIGS. 9 to 11 are schematic drawings illustrating the action of placing the pistol (101) downwardly into the protective holster main sandwich (2). FIG. 12 shows the action drawing the pistol (101) upwardly out of the protective holster main sandwich (2). As indicated in those Figures, the left side of the outer rim of the protective holster main sandwich (2) faces toward the human body, that especially suits the user who is accustomed to hanging the pistol (101) on the right waist side and holding the pistol (101) by the right hand. At this moment, the triangular clamping and receiving member (211) is located adjacent to the human body and the trapezoidal clamping and receiving member (221) is away from the human body side. The spring leaf (212) is disposed between the triangular clamping and receiving member (211) and the wall of the main body of the protective holster main sandwich (2). The spring leaf (222) is disposed between the trapezoidal clamping and receiving member (221) and the wall of the main body of the protective holster main sandwich (2).

As illustrated in FIGS. 9 and 10, when the pistol (101) is downwardly placed into the protective holster main sandwich (2), the muzzle points downwardly, the trigger guard (113) is in an L shape configuration (referring to FIG. 8) and the bottom side (114) thereof is located below the trigger (112). Since the widths of the trigger guard (113) and the bottom side (114) are greater than that of the trigger (112) (that is of a general pistol regulation), when the pistol (101) is downwardly placed into the protective holster main sandwich (2), the bottom side (114) of the trigger guard (113) pushes against the upper aspects of the two opposite clamping and receiving members (211, 221). Since the upper aspect of the clamping and receiving member (211) is the slanted side on a triangular top portion (213) and the clamping and receiving member (221) is a trapezoidal and slanted side (231), to continuously exert a force to push the pistol (101) downwardly, the bottom side (114) of the trigger guard (113) pushes the clamping an receiving members (211, 221) outwardly, as shown in FIG. 10. At this moment, the wall thickness of the main body of the protective holster main sandwich (2) and the two spring leaves (212, 222) are also pushed outwardly to deform and generate a resilient resuming force.

As indicated in FIG. 11, after the bottom side (114) of the trigger guard (113) pushes the clamping and receiving members (211, 221), the wall thickness of the main body of the protective holster main sandwich (2) and two spring leaves (212, 222) outwardly to displace downwardly to pass the triangular top portion (213) and since the width of the trigger (112) is less than that of the bottom side (114) of the trigger guard (113), the spring leaf (212) and the wall thickness of the protective holster main sandwich (2) on that side generate a resilient resuming force to push the triangular top portion (213) to lean against the lateral side of the trigger (112). When the bottom side (114) of the trigger guard (113) displaces downwardly past a side (241) at the lower aspect of the trapezoidal clamping and receiving member (221), the spring leaf (222) and the wall thickness of the main body of the protective holster main sandwich (2) on that side generate a resilient resuming force to push the trapezoidal clamping and receiving member (221) against the lateral outer side of the trigger (112). At this time, the two sides of the trigger (112) are respectively clamped and pushed by the clamping and receiving members (211, 221)

thereby preventing the pistol (101) from swaying inside the protective holster main sandwich (2). Furthermore, the lower side (241) at the lower aspect of the clamping and receiving member (221) is located above the bottom side (114) of the trigger guard (113) (referring to FIG. 11). Therefore, when trying to exert force vertically and upwardly on the pistol (101) of to draw the pistol (101) out of the protective holster main sandwich (2) slantly away from the human body, the upper aspect of the bottom side (114) of the trigger guard (113) is blocked by the lower side (241)of the clamping and receiving member (221) thereby preventing the pistol (101) from being drawn by a person other than the user.

As indicated in FIG. 12, to draw the pistol (101) out of the protective holster main sandwich (2), the user first exerts force onto the pistol (101) toward the human body to make the trigger (112) push the clamping and receiving member (211) as well as the spring leaf (212) on that side and the wall thickness of the protective holster main sandwich (2) to enable the entire pistol (101) to slightly offset toward the human body and disengage the clamping and receiving member (221) from the trigger (112). Since the bottom side (114) of the trigger guard (113) is located away from the human body, when the force is exerted upwardly on the pistol (101), the upper aspect of the bottom side (114) of the trigger guard (113) is not blocked by the lower side (241) of the clamping and receiving member (221) thereby allowing the pistol (101) to be drawn upwardly.

As indicated in FIG. 4, a self-adhesive fastening belt (252) is respectively disposed between the snap member (251) and the insertion slot casing (25) to make the snap member (251) adhere with the insertion slot casing (25) temporarily; then the screw member (291) engages with the through bind member (29) and the insertion slot casing (25) thereby clamping the snap member (251) between the through bind member (29) and the insertion slot casing (2) When adjusting the high or low position of the snap member (251), the screw member (291) is loosened and dismounted from the through bind member (29). Since the snap member (251) and the insertion slot casing member (251) is detached to be re-fastened at a proper height.

As indicated in FIG. 6, a snap member (251) is located on the lateral side of the pistol holster (30) with a press snap at the upper aspect; the sub snap member (253) is located on the other side of the pistol holster (30) with a corresponding press snap at the upper aspect thereof as well. Two press snap face outwardly when the pistol (101) is note placed in; after the pistol (101) is placed into the pistol holster (30), the upper aspect of the sub snap member (253) folds inwardly to make the inner side of the sub snap member (253) circle around the pistol (101) grip (not shown) thereby turning the press snapper of the sub snap member (253) to face inwardly to align with the press snap of the snap member (251) so as to snap the press snap together. The snapped sub snap member (253) limits the position of the pistol (101) inside the pistol holster (30) to prevent it from being drawn until the press snaps of the snap and the sub snap member (251 253) are detached.

I claim:

1. A protective pistol holster for a pistol having a trigger and a trigger guard, the protective holster having a safety device comprising:

a) a protective holster main sandwich configured to receive the pistol therein and including a triangular clamping and receiving member located on a first side of an interior of the holster main sandwich and a trapezoidal clamping and receiving member located on a second side of the interior of the holster main sandwich opposite from the triangular clamping and receiving member, the triangular and trapezoidal clamping and receiving members positioned so as to be located within the trigger guard and bear against the opposite sides of the trigger when the pistol is received in the holster main sandwich so as to prevent inadvertent removal of the piston therefrom;

b) two strip-shaped spring leaves, affixed to a rear side of the protective holster main sandwich, adjacent to positions of the triangular and trapezoidal clamping and receiving members, and clasped therein by a clasping piece from an outside of the protective holster main sandwich, wherein the two strip-shaped spring leaves are respectively clasped to rear sides of the triangular and trapezoidal clamping and receiving members respectively to exert a clamping action on the opposite sides of the trigger and whereby a lower side of the trapezoidal clamping and receiving member engages the trigger guard;

c) a frame protecting cover affixed to an exterior of the protective holster main sandwich; and, d) an expanding member affixed to a notch area between opposite sides of the protective holster main sandwich.

2. The protective pistol holster of claim 1, further comprising:

a) a first snap member adjustably attached to a first side of the protective holster main sandwich; and b) a second snap member attached to a second side of the protective holster main sandwich opposite the first side, the second snap member releasably engaging the first snap member.

3. The protective pistol holster of claim 1, further comprising a through bind member attached to the protective holster main sandwich to enable the protective holster to be attached to a belt of the user.

4. The protective pistol holster of claim 1 wherein the expanding member is affixed to the protective holster main sandwich by threaded fasteners.

5. The protective pistol holster of claim 1 wherein the protective holster main sandwich has a U-shaped cross-sectional configuration.

* * * * *